US007168672B2

(12) United States Patent
Hsu

(10) Patent No.: US 7,168,672 B2
(45) Date of Patent: Jan. 30, 2007

(54) MULTIFUNCTIONAL SUPPORT RACK

(75) Inventor: Fu-Lu Hsu, Lu Kang Chen (TW)

(73) Assignee: Luh Da Industry Corp., Lu Kang Chen (TW)

( * ) Notice: Subject to any disclaimer, the term of this patent is extended or adjusted under 35 U.S.C. 154(b) by 145 days.

(21) Appl. No.: 10/945,706

(22) Filed: Sep. 21, 2004

(65) Prior Publication Data

US 2006/0060746 A1 Mar. 23, 2006

(51) Int. Cl.
*A47B 97/04* (2006.01)

(52) U.S. Cl. ..... 248/444; 248/441.1; 248/448; 248/454; 248/447; 248/449; 248/455; 400/718; 281/30

(58) Field of Classification Search ..... 248/444, 248/441.1, 448, 454, 118.3, 447, 449, 455, 248/457, 460, 463; 400/718; 281/30
See application file for complete search history.

(56) References Cited

U.S. PATENT DOCUMENTS 768,483 A * 8/1904 Rivers ..... 248/457
4,987,690 A * 1/1991 Aaldenberg et al. ..... 40/341
5,052,650 A * 10/1991 Beile et al. ..... 248/451
5,058,242 A * 10/1991 Liu et al. ..... 24/67.7
5,366,197 A * 11/1994 Westland ..... 248/456
5,451,025 A * 9/1995 Hames ..... 248/456
5,464,293 A * 11/1995 Hall ..... 400/718
5,746,410 A * 5/1998 Hung ..... 248/441.1
5,797,578 A * 8/1998 Graffeo et al. ..... 248/453
5,823,500 A * 10/1998 La Coste ..... 248/444

* cited by examiner

*Primary Examiner*—Carl D. Friedman
*Assistant Examiner*—Todd M. Epps
(74) *Attorney, Agent, or Firm*—Alan D. Kamrath; Nikolai & Mersereau, P.A.

(57) ABSTRACT

A support rack includes a support plate, a support stand, a locking member, a pen holder, an indication member, and two auxiliary clips. Thus, the support rack functions as a clipboard, a book rack, an exhibition rack, a price indication rack, a pen holder or the like, thereby enhancing the versatility of the support rack. In addition, the support stand is adjustably mounted on the locking member so as to adjust the inclined angle between the support plate and the support stand, thereby facilitating a user adjusting the inclined angle of the support rack to the optimum extent.

18 Claims, 7 Drawing Sheets

MULTIFUNCTIONAL SUPPORT RACK

BACKGROUND OF THE INVENTION

1. Field of the Invention

The present invention relates to a support rack, and more particularly to a multifunctional support rack that functions as a clipboard, a book rack, an exhibition rack, a price indication rack, a pen holder or the like.

2. Description of the Related Art

A conventional support rack for a computer in accordance with the prior art shown in FIG. 10 comprises a holder 1 mounted on a table 5, an extension arm 2 mounted on the holder 1, a joint 3 pivotally mounted on the extension arm 2, and a support board 4 mounted on the joint 3 for placing paper, document or the like. However, the joint 3 is often limited to the length of the extension arm 2, so that the inclined angle of the support board 4 cannot be freely adjusted to the optimum value to fit a user requirement, thereby causing inconvenience to the user in adjustment of the inclined angle of the support board 4. In addition, the conventional support rack cannot be folded largely, so that the conventional support rack has a larger volume when not in use, thereby causing inconvenience to the user in package, storage and transportation of the conventional support rack.

SUMMARY OF THE INVENTION

In accordance with the present invention, there is provided a support rack, comprising:

a support plate;

a support stand pivotally mounted on the support plate;

a locking member pivotally mounted on the support plate and detachably locked on the support stand to secure the support stand on the support plate;

a pen holder movably mounted on the support plate;

an indication member movably mounted on the support plate; and two auxiliary clips each slidably mounted on the support plate.

The primary objective of the present invention is to provide a multifunctional support rack that functions as a clipboard, a book rack, an exhibition rack, a price indication rack, a pen holder or the like, thereby enhancing the versatility of the support rack.

Another objective of the present invention is to provide a support rack, wherein the paper is fixed on the support plate rigidly and stably by the elastic clip of the support plate and the clamping portion of each of the two auxiliary clips.

A further objective of the present invention is to provide a support rack, wherein the support stand is adjustably mounted on the locking member so as to adjust the inclined angle between the support plate and the support stand, thereby facilitating a user adjusting the inclined angle of the support rack to the optimum extent.

A further objective of the present invention is to provide a support rack, wherein the locking member an the support stand are folded when not in use to decrease the volume of the support rack, thereby facilitating, package, storage and transportation of the support rack.

Further benefits and advantages of the present invention will become apparent after a careful reading of the detailed description with appropriate reference to the accompanying drawings.

DETAILED DESCRIPTION OF THE INVENTION

Figure 1:
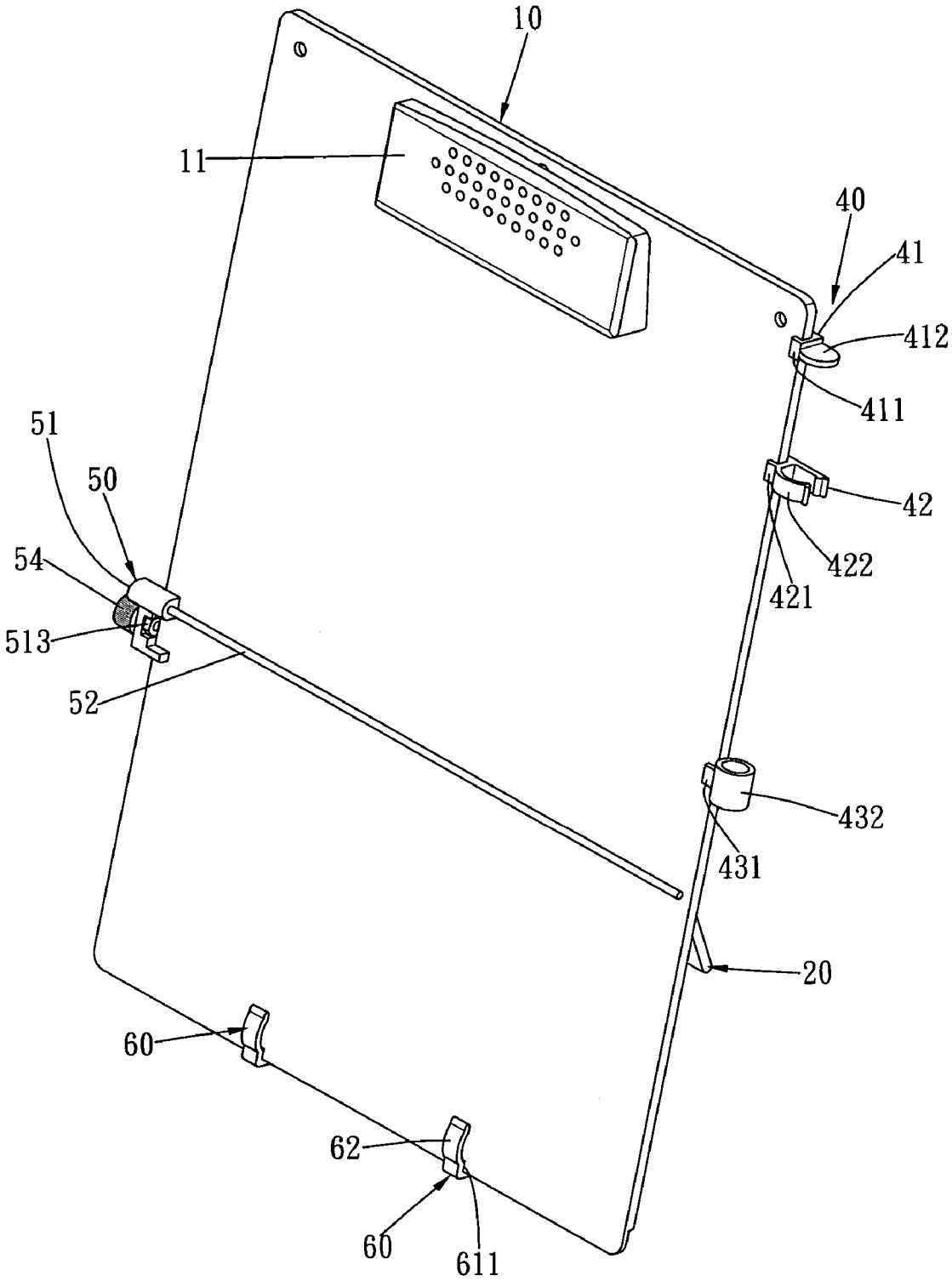
FIG. 1 is a perspective view of a support rack in accordance with the preferred embodiment of the present invention.

Referring to the drawings and initially to FIGS. 1–6, a support rack in accordance with the preferred embodiment of the present invention comprises a support plate 10, a support stand 20 pivotally mounted on the support plate 10, a locking member 30 pivotally mounted on the support plate 10 and detachably locked on the support stand 20 to secure the support stand 20 on the support plate 10, a pen holder 40 movably mounted on the support plate 10, an indication member 50 movably mounted on the support plate 10, and two auxiliary clips 60 each slidably mounted on the support plate 10.

The support plate 10 has a first face provided with an elastic clip 11 and a second face formed with two first pivot ears 12 and two second pivot ears 13. The second face of the support plate 10 has a periphery formed with a peripheral rib 14.

The support stand 20 has a bifurcated first end formed with two inward extended pivot shafts 21 pivotally mounted on the first pivot ears 12 of the support plate 10, a mediate portion formed with a locking slot 22 and a second end formed with a locking stub 24. The first end of the support stand 20 is formed with a locking stud 23. The support stand 20 has a width gradually increased from the first end to the second end thereof. The locking slot 22 of the support stand 20 is substantially T-shaped and is formed with two hook-shaped opposite elastic snapping portions 221. A slit 222 is defined between each of the snapping portions 221 and a peripheral wall of the locking slot 22 of the support stand 20.

The locking member 30 has a bifurcated first end formed with two outward extended pivot shafts 31 pivotally mounted on the second pivot ears 13 of the support plate 10 and a second end detachably locked in the locking slot 22 of the support stand 20. The locking member 30 has two opposite sides each formed with a plurality of locking grooves 33, and each of the snapping portions 221 of the locking slot 22 of the support stand 20 is detachably locked in a respective one of the locking grooves 33 of the locking member 30. The locking member 30 has an inside formed with an elongated slot 32.

The pen holder 40 is movably mounted on a first side of the support plate 10 and includes a catch seat 41 having a first end formed with a slide 411 slidably mounted on the first side of the support plate 10 and a second end formed with a catch plate 412, a holding seat 42 having a first end formed with a slide 421 slidably mounted on the first side of the support plate 10 and a second end formed with a C-shaped clamping portion 422, and a support seat 43 having a first end formed with a slide 431 slidably mounted on the first side of the support plate 10 and a second end formed with a socket 432.

The slide 411 of the catch seat 41 has an inside formed with a slideway 4111 slidably mounted on the first side of the support plate 10 and a peripheral wall formed with a screw bore 4112 communicating with the slideway 4111, and a locking screw 70 is screwed into the screw bore 4112 of the slide 411 of the catch seat 41 and urged on the peripheral rib 14 of the first side of the support plate 10 to secure the slide 411 of the catch seat 41 on the first side of the support plate 10.

The slide 421 of the holding seat 42 has an inside formed with a slideway 4211 slidably mounted on the first side of the support plate 10 and a peripheral wall formed with a screw bore 4212 communicating with the slideway 4211, and a locking screw 700 is screwed into the screw bore 4212 of the slide 421 of the holding seat 42 and urged on the peripheral rib 14 of the first side of the support plate 10 to secure the slide 421 of the holding seat 42 on the first side of the support plate 10.

The slide 431 of the support seat 43 has an inside formed with a slideway 4311 slidably mounted on the first side of the support plate 10 and a peripheral wall formed with a screw bore 4312 communicating with the slideway 4311, and a locking screw 702 is screwed into the screw bore 4312 of the slide 431 of the support seat 43 and urged on the peripheral rib 14 of the first side of the support plate 10 to secure the slide 431 of the support seat 43 on the first side of the support plate 10.

The indication member 50 includes a slide 51 slidably mounted on a second side of the support plate 10, and a horizontal bar 52 movably mounted on the first face of the support plate 10 and having a distal end secured to the slide 51 to move therewith. The slide 51 of the indication member 50 has an inside formed with a slideway 511 slidably mounted on the second side of the support plate 10 and a peripheral wall formed with a through hole 512 communicating with the slideway 511.

The indication member 50 further includes a press plate 514 mounted in the slideway 511 of the slide 51 and urged on the second side of the support plate 10, a lock nut 513 secured in the slideway 511 of the slide 51 and rested on the press plate 514, a locking knob 54 rotatably mounted on the slide 51 and having a threaded rod 540 extended through the through hole 512 of the slide 51, screwed into the lock nut 513 and urged on the press plate 514 to press the press plate 514 on the second side of the support plate 10 closely, so that the slide 51 is fixed on the second side of the support plate 10, and a washer 515 mounted in the slideway 511 of the slide 51 to retain the press plate 514.

Each of the two auxiliary clips 60 has a first end formed with a slide 61 slidably mounted on a distal end of the support plate 10 and a second end formed with an arc-shaped clamping portion 62 rested on the first face of the support plate 10. The slide 61 of each of the two auxiliary clips 60 has an inside formed with a slideway 611 slidably mounted on the distal end of the support plate 10.

As shown in FIG. 1, when paper of document (not shown) is placed on the first face of the support plate 10, the paper has an upper end clamped by the elastic clip 11 of the support plate 10 and a lower end clamped by the clamping portion 62 of each of the two auxiliary clips 60, so that the paper is fixed on the support plate 10 rigidly and stably.

Figure 2:
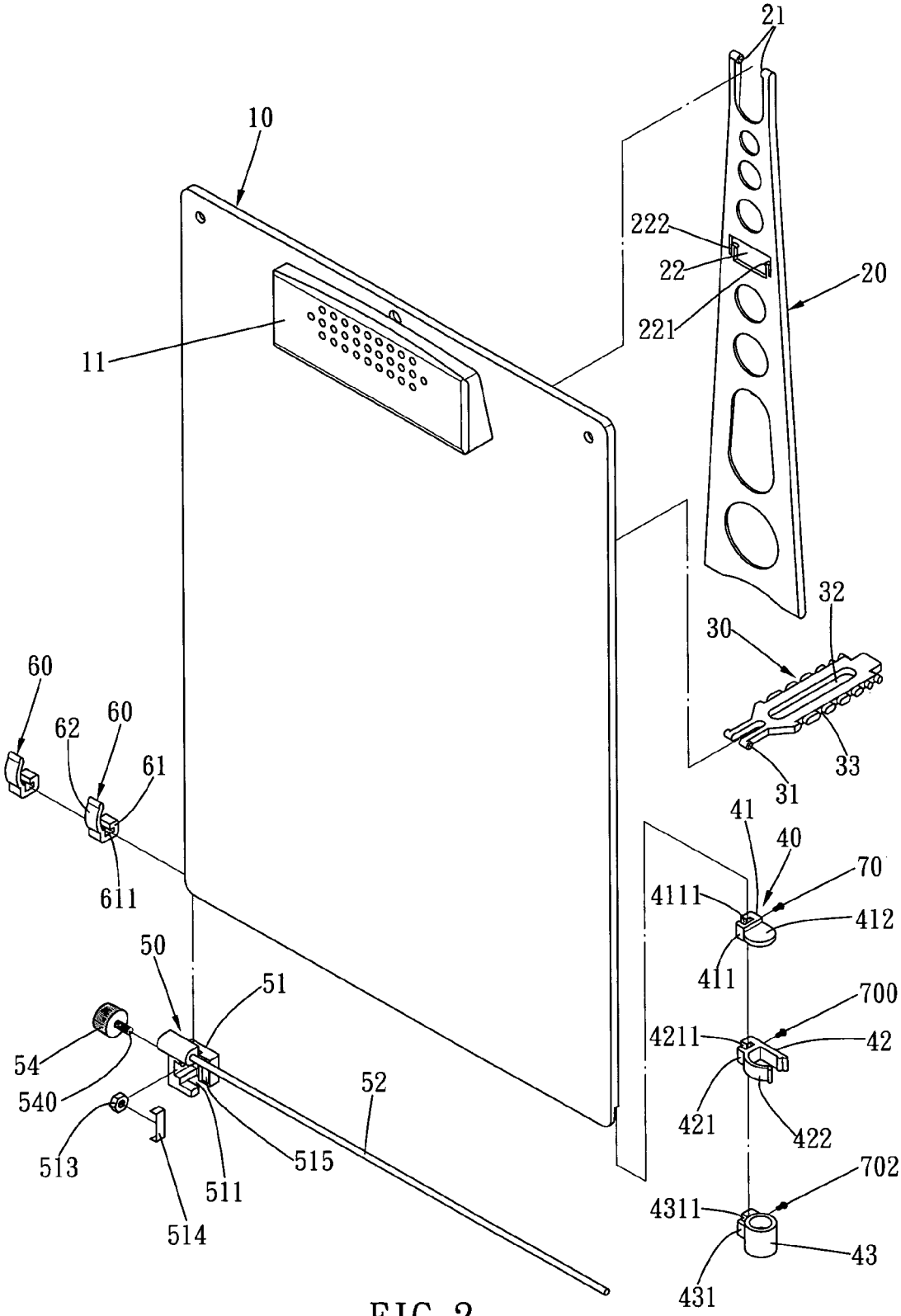
FIG. 2 is an exploded perspective view of the support rack as shown in FIG. 1.
Figure 3:
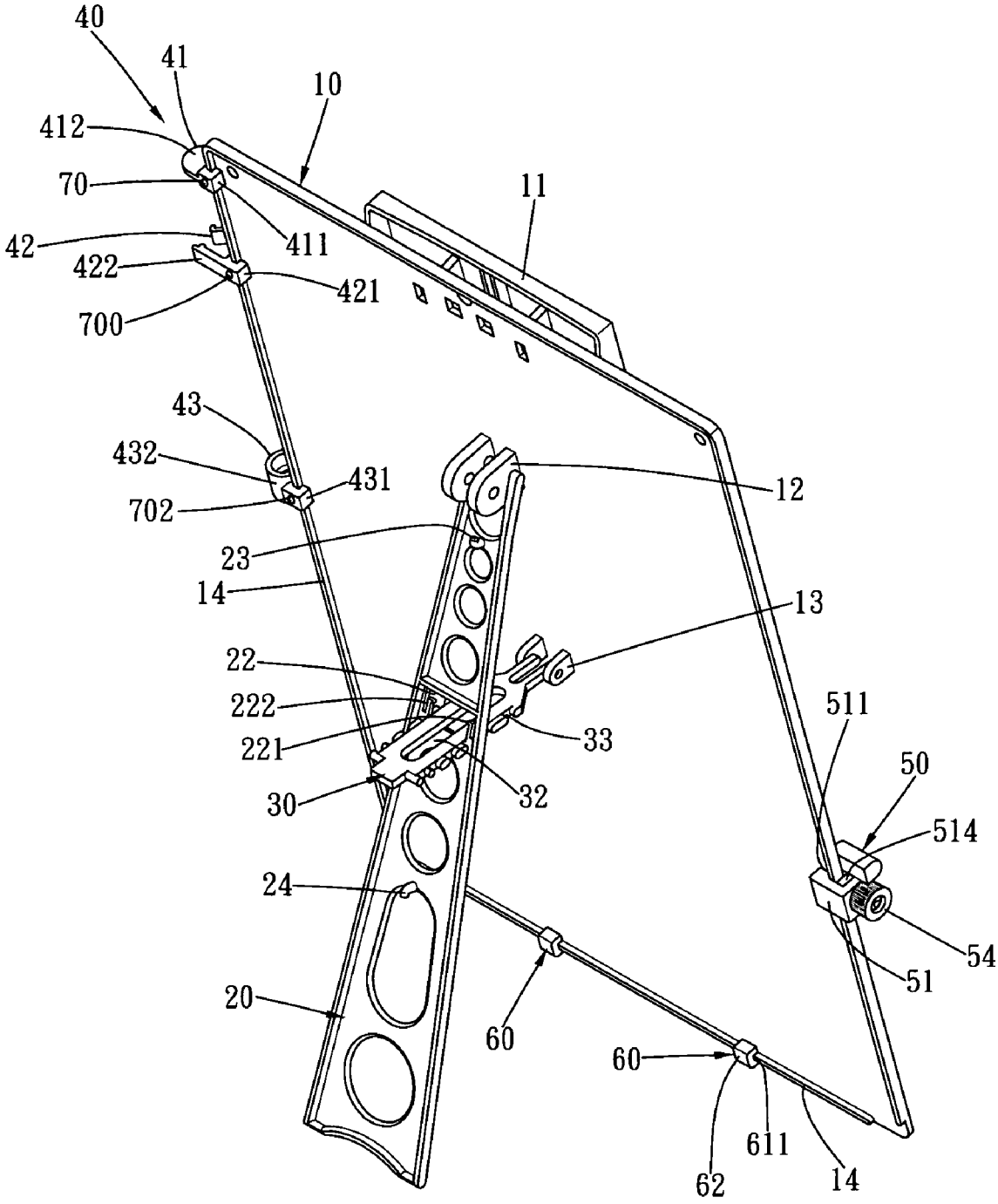
FIG. 3 is a perspective view of the support rack in accordance with the preferred embodiment of the present invention.
Figure 4:
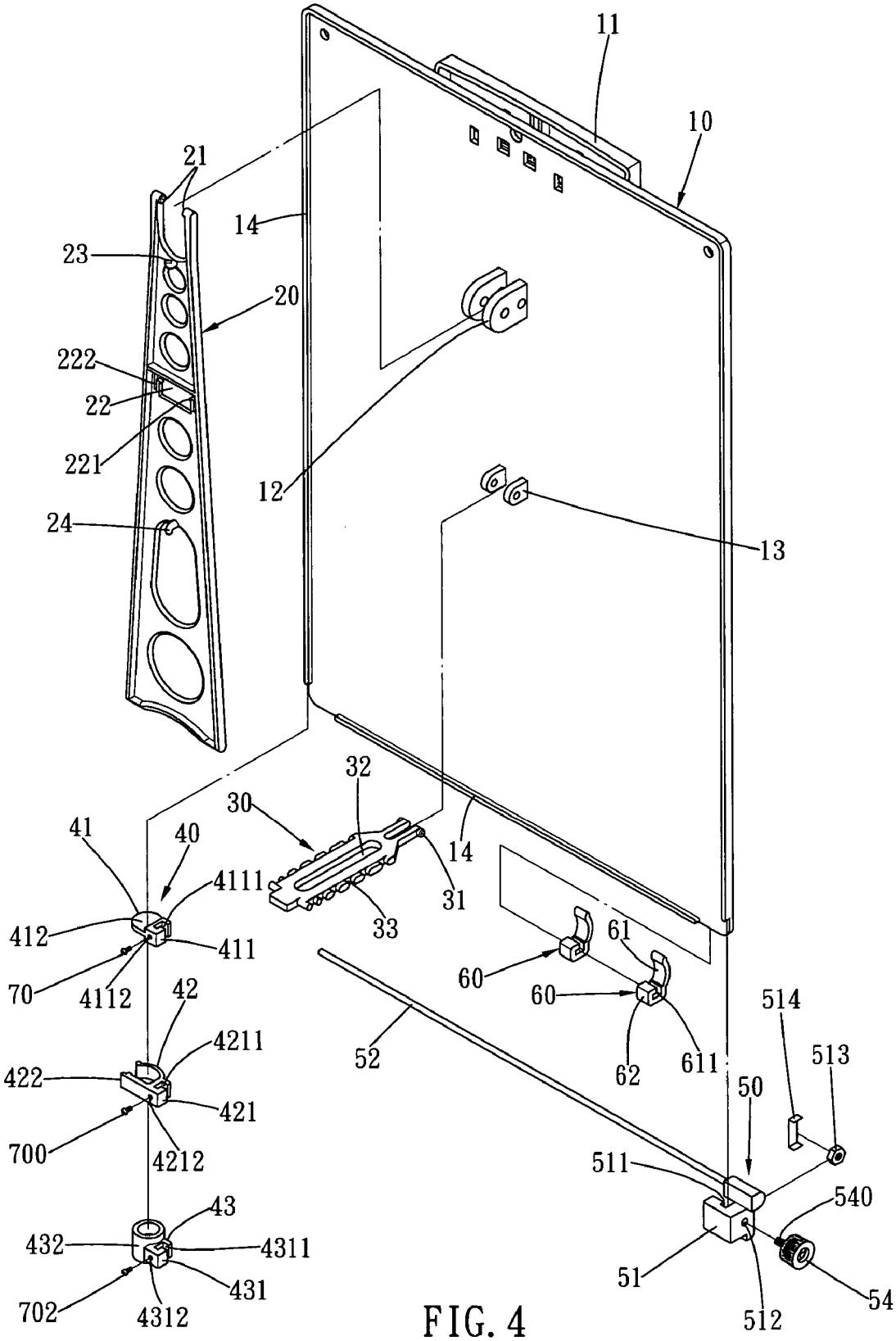
FIG. 4 is an exploded perspective view of the support rack as shown in FIG. 3.
Figure 5:
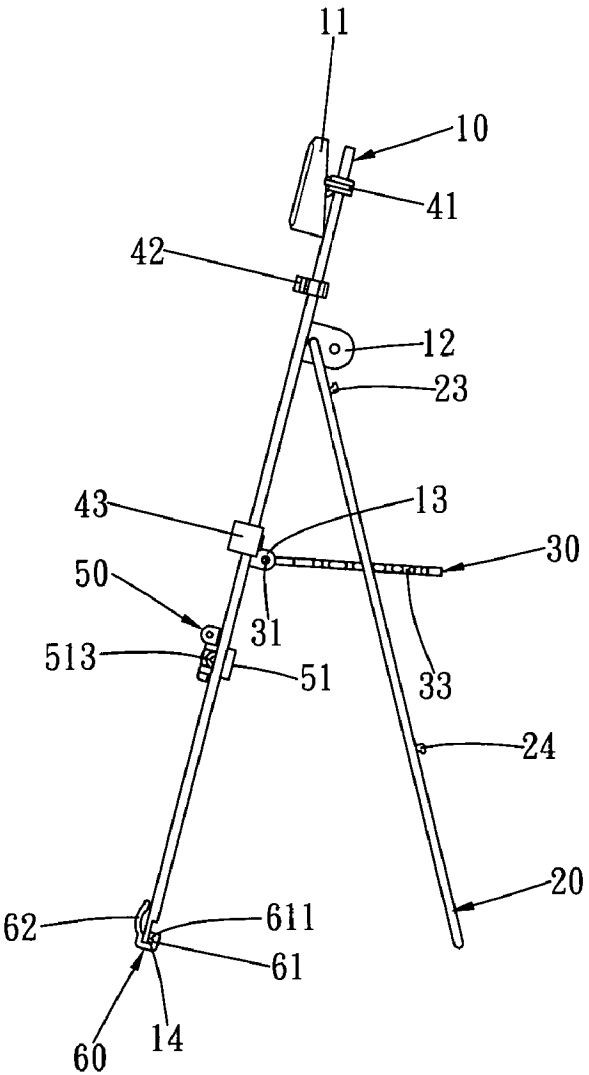
FIG. 5 is a side plan view of the support rack as shown in FIG. 1.

As shown in FIGS. 2 and 5, each of the snapping portions 221 of the locking slot 22 of the support stand 20 is detachably locked in a respective one of the locking grooves 33 of the locking member 30, so that the support stand 20 is adjustably mounted on the locking member 30 so as to adjust the inclined angle between the support plate 10 and the support stand 20.

Figure 6:
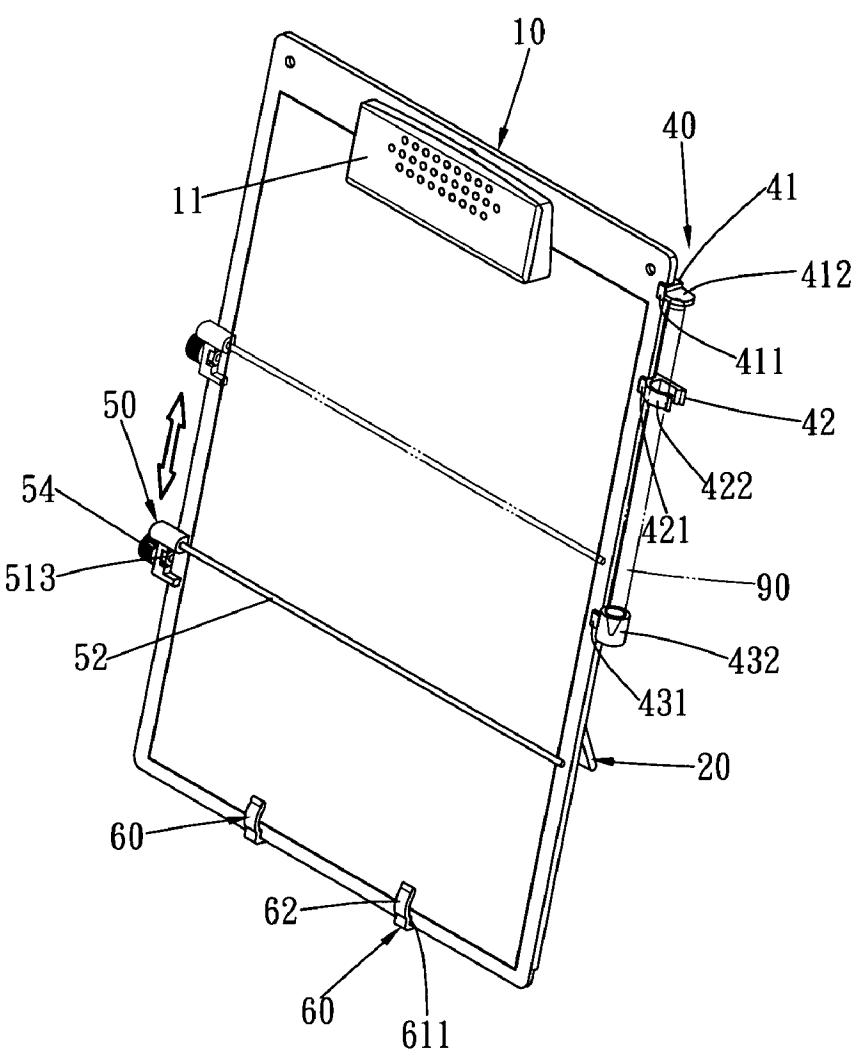
FIG. 6 is a schematic operational view of the support rack as shown in FIG. 1.

As shown in FIG. 6, when a pen 90 is placed on the pen holder 40, the pen 90 is held by the holding seat 42 and has an upper end stopped by the catch seat 41 and a lower end inserted into the support seat 43. In addition, the pen holder 40 is movable on the first side of the support plate 10 so as to adjust the position of the pen 90. In addition, the indication member 50 is movable on the first face of the support plate 10 by operation of the locking knob 54 so as to adjust the position of the horizontal bar 52 to provide an indication effect.

Figure 9:
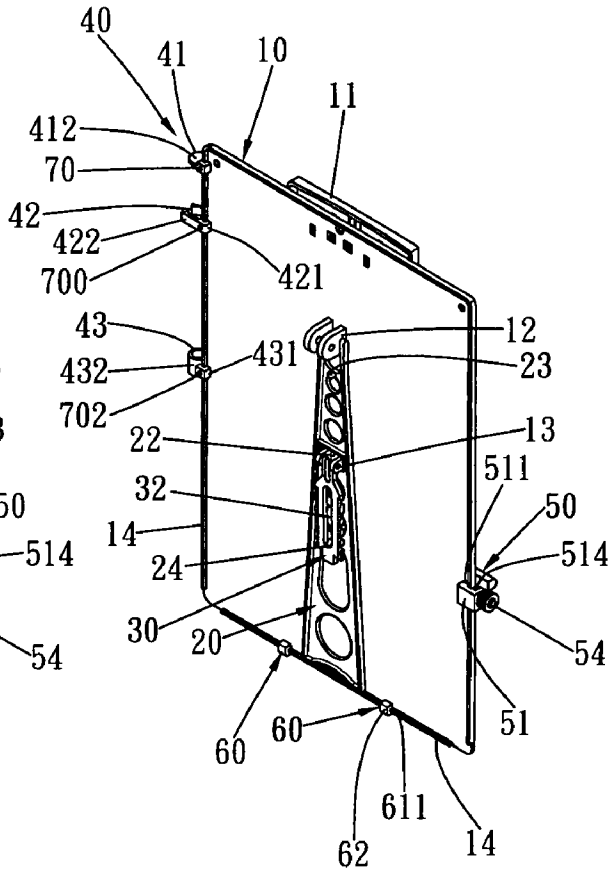
FIG. 9 is a schematic operational view of the support rack as shown in FIG. 8.
Figure 8:
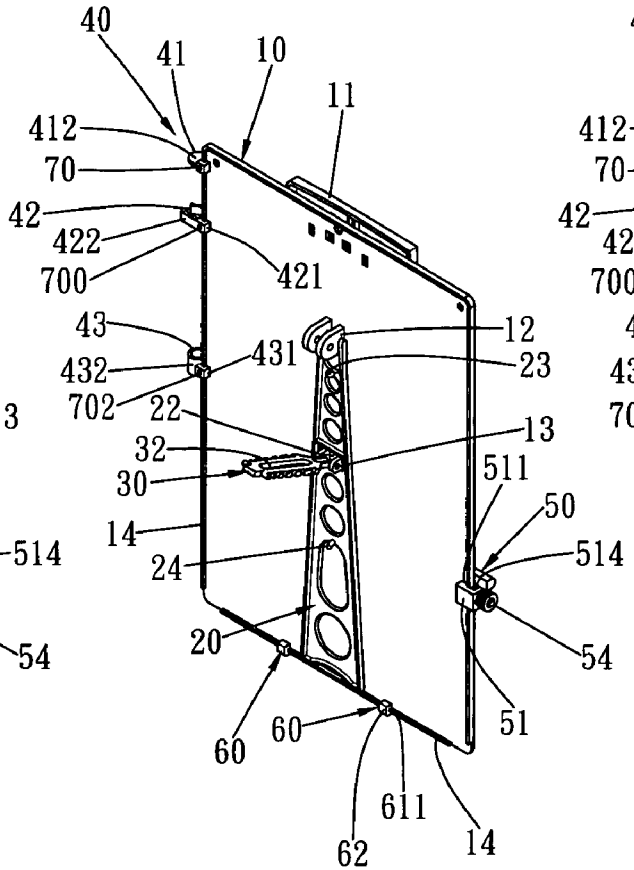
FIG. 8 is a schematic operational view of the support rack as shown in FIG. 7.
Figure 7:
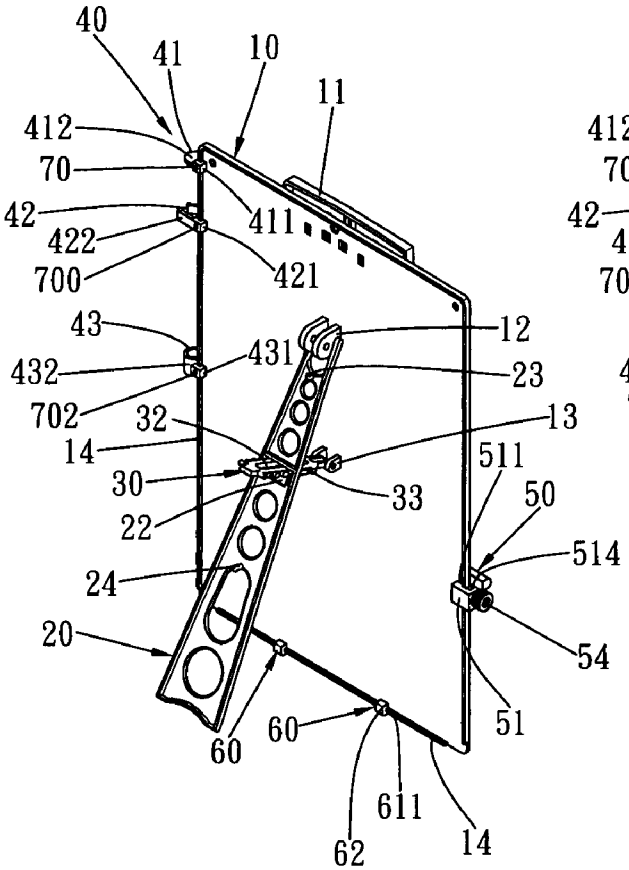
FIG. 7 is a schematic operational view of the support rack as shown in FIG. 3.
Figure 10:
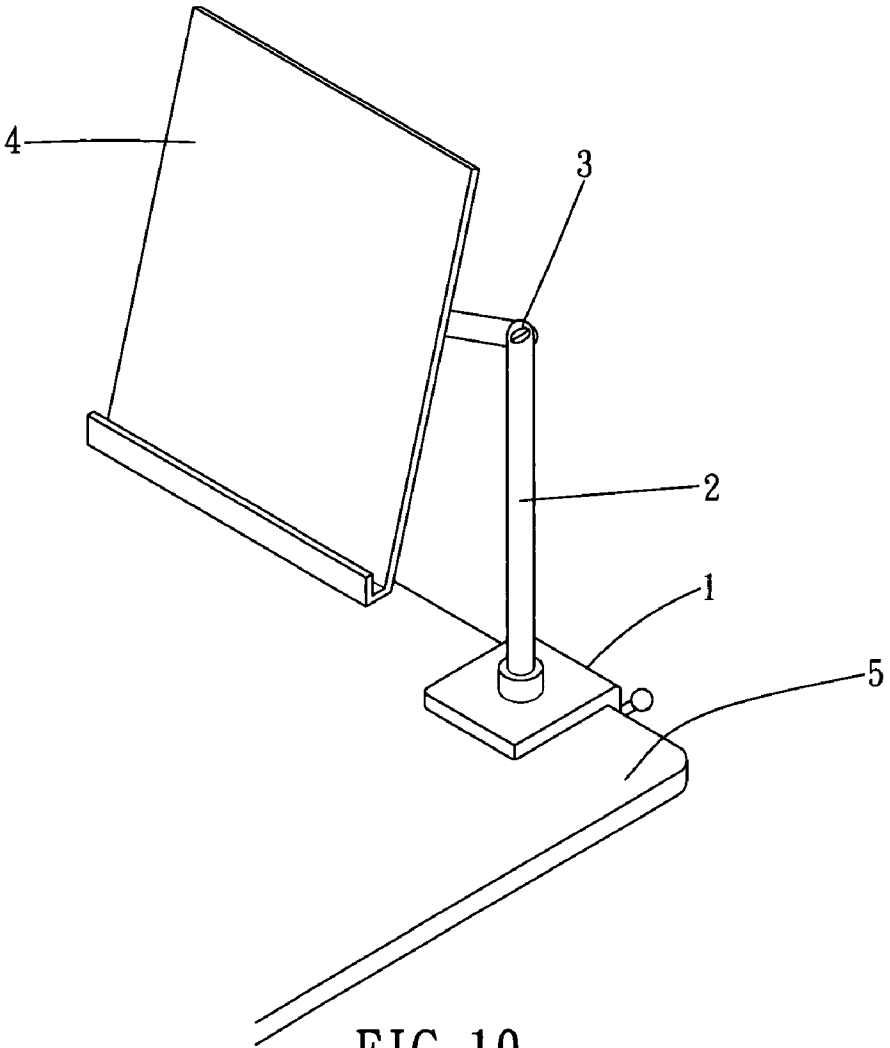
FIG. 10 PRIOR ART
FIG. 10 is a perspective view of a conventional support rack in accordance with the prior art.

Referring to FIGS. 7–9, when not in use, the locking member 30 is pushed upward to detach the snapping portions 221 of the locking slot 22 of the support stand 20 from the locking grooves 33 of the locking member 30, so that the support stand 20 is unlocked from the locking member 30 as shown in FIG. 7. Then, the support stand 20 is pushed to move toward the second face of the support plate 10 until the support stand 20 is rested on the second face of the support plate 10 as shown in FIG. 8. Finally, the locking member 30 is pivoted downward to move toward the second face of the support plate 10 until the locking member 30 is rested on the support stand 20 as shown in FIG. 9, thereby folding the locking member 30 an the support stand 20 onto the second face of the support plate 10. At this time, the locking stub 24 of the support stand 20 is locked on an end of the elongated slot 32 of the locking member 30, thereby fixing the support stand 20 on the locking member 30.

Alternatively, when the locking member 30 is pivoted downward to move toward the second face of the support plate 10, the locking stub 23 of the support stand 20 is locked on an end of the elongated slot 32 of the locking member 30, thereby fixing the support stand 20 on the locking member 30.

Accordingly, the support rack functions as a clipboard, a book rack, an exhibition rack, a price indication rack, a pen holder or the like, thereby enhancing the versatility of the support rack. In addition, the paper is fixed on the support plate 10 rigidly and stably by the elastic clip 11 of the support plate 10 and the clamping portion 62 of each of the two auxiliary clips 60. Further, the support stand 20 is adjustably mounted on the locking member 30 so as to adjust the inclined angle between the support plate 10 and the support stand 20, thereby facilitating a user adjusting the inclined angle of the support rack to the optimum extent. Further, the locking member 30 an the support stand 20 are folded when not in use to decrease the volume of the support rack, thereby facilitating, package, storage and transportation of the support rack.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A support rack, comprising:

a support plate;

a support stand pivotally mounted on the support plate;

a locking member pivotally mounted on the support plate and detachably locked on the support stand to secure the support stand on the support plate;

a pen holder movably mounted on the support plate;

an indication member movably mounted on the support plate; and two auxiliary clips each slidably mounted on the support plate;

wherein the locking member has two opposite sides each formed with a plurality of locking grooves, and the support stand has a mediate portion formed with a locking slot for passage of the locking member and formed with two hook-shaped opposite elastic snapping portions each detachably locked in a respective one of the locking grooves of the locking member.

2. The support rack in accordance with claim 1, wherein the locking slot of the support stand is substantially T-shaped.

3. The support rack in accordance with claim 1, wherein a slit is defined between each of the snapping portions and a peripheral wall of the locking slot of the support stand.

4. The support rack in accordance with claim 1, wherein the support plate has a face formed with two first pivot ears and two second pivot ears, the support stand has a bifurcated first end formed with two inward extended pivot shafts pivotally mounted on the first pivot ears of the support plate, and the locking member has a bifurcated first end formed with two outward extended pivot shafts pivotally mounted on the second pivot ears of the support plate and a second end detachably locked in the locking slot of the support stand.

5. The support rack in accordance with claim 4, wherein the locking member has an inside formed with an elongated slot, and the support stand has a second end formed with a locking stub locked on an end of the elongated slot of the locking member.

6. The support rack in accordance with claim 5, wherein the support stand has a width gradually increased from the first end to the second end thereof.

7. The support rack in accordance with claim 4, wherein the locking member has an inside formed with an elongated slot, and the first end of the support stand is formed with a locking stud locked on an end of the elongated slot of the locking member.

8. The support rack in accordance with claim 1, wherein the indication member includes a slide slidably mounted on a second side of the support plate, and a horizontal bar movably mounted on the first face of the support plate and having a distal end secured to the slide to move therewith.

9. The support rack in accordance with claim 8, wherein the slide of the indication member has an inside formed with a slideway slidably mounted on the second side of the support plate.

10. The support rack in accordance with claim 9, wherein the slide of the indication member has a peripheral wall formed with a through-hole communicating with the slideway, and the indication member further includes a press plate mounted in the slideway of the slide and urged on the second side of the support plate, a lock nut secured in the slideway of the slide and rested on the press plate, and a locking knob rotatably mounted on the slide and having a threaded rod extended through the through-hole of the slide, screwed into the lock nut and urged on the press plate to press the press plate on the second side of the support plate, so that the slide is fixed on the second side of the support plate.

11. The support rack in accordance with claim 10, wherein the indication member further includes a washer mounted in the slideway of the slide to retain the press plate.

12. The support rack in accordance with claim 1, wherein each of the two auxiliary clips has a first end formed with a slide slidably mounted on a distal end of the support plate and a second end formed with an arc-shaped clamping portion rested on the face of the support plate.

13. The support rack in accordance with claim 12, wherein the slide of each of the two auxiliary clips has an inside formed with a slideway slidably mounted on the distal end of the support plate.

14. The support rack in accordance with claim 1, wherein the support plate has a face provided with an elastic clip.

15. The support rack in accordance with claim 1, wherein the support plate has a face having a periphery formed with a peripheral rib.

16. A support rack, comprising:

a support plate;

a support stand pivotally mounted on the support plate;

a locking member pivotally mounted on the support plate and detachably locked on the support stand to secure the support stand on the support plate;

a pen holder movably mounted on the support plate;

an indication member movably mounted on the support plate;

two auxiliary clips each slidably mounted on the support plate;

wherein the pen holder is movably mounted on a first side of the support plate and includes a catch seat having a first end formed with a slide slidably mounted on the first side of the support plate and a second end formed with a catch plate, a holding seat having a first end formed with a slide slidably mounted on the first side of the support plate and a second end formed with a C-shaped clamping portion, and a support seat having a first end formed with a slide slidably mounted on the first side of the support plate and a second end formed with a socket;

wherein the slide of the catch seat has an inside formed with a slideway slidably mounted on the first side of the support plate and a peripheral wall formed with a screw bore communicating with the slideway, and a locking screw is screwed into the screw bore of the slide of the catch seat and urged on the peripheral rib of the first side of the support plate to secure the slide of the catch seat on the first side of the support plate.

17. The support rack in accordance with claim 16, wherein the slide of the support seat has an inside formed with a slideway slidably mounted on the first side of the support plate and a peripheral wall formed with a screw bore communicating with the slideway, and a locking screw is screwed into the screw bore of the slide of the support seat and urged on the peripheral rib of the first side of the support plate to secure the slide of the support seat on the first side of the support plate.

18. A support rack, comprising:

a support plate;

a support stand pivotally mounted on the support plate;

a locking member pivotally mounted on the support plate and detachably locked on the support stand to secure the support stand on the support plate;

a pen holder movably mounted on the support plate;

an indication member movably mounted on the support plate;

two auxiliary clips each slidably mounted on the support plate;

wherein the pen holder is movably mounted on a first side of the support plate and includes a catch seat having a first end formed with a slide slidably mounted on the first side of the support plate and a second end formed with a catch plate, a holding seat having a first end formed with a slide slidably mounted on the first side of the support plate and a second end formed with a C-shaped clamping portion, and a support seat having a first end formed with a slide slidably mounted on the first side of the support plate and a second end formed with a socket;

wherein the slide of the holding seat has an inside formed with a slideway slidably mounted on the first side of the support plate and a peripheral wall formed with a screw bore communicating with the slideway, and a locking screw is screwed into the screw bore of the slide of the holding seat and urged on the peripheral rib of the first side of the support plate to secure the slide of the holding seat on the first side of the support plate.

* * * * *